US006810813B2

(12) United States Patent
Chretinat et al.

(10) Patent No.: US 6,810,813 B2
(45) Date of Patent: Nov. 2, 2004

(54) DEVICE AND METHOD FOR CONTROLLING REGISTRATION IN A PRINTING PRESS

(75) Inventors: Michel Chretinat, Agnetz (FR); Leon Christopher Cote, Newmarket, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/388,956

(22) Filed: Mar. 14, 2003

(65) Prior Publication Data

US 2004/0177785 A1 Sep. 16, 2004

(51) Int. Cl.[7] ..... B41F 13/02; B41F 13/24

(52) U.S. Cl. ..... 101/485; 101/486; 101/211; 101/348; 270/4; 270/20.1; 700/124

(58) Field of Search ..... 101/485, 486, 101/211, 348, 216, 365, 181; 270/4, 20.1, 21.1; 700/124

(56) References Cited

U.S. PATENT DOCUMENTS 3,977,665 A * 8/1976 Bowman et al. ..... 270/21.1
4,411,194 A * 10/1983 Davidson, Jr. ..... 101/26
4,660,159 A * 4/1987 Ott ..... 101/365
4,665,824 A * 5/1987 Greiner et al. ..... 101/DIG. 45
4,963,029 A * 10/1990 Kipphan ..... 101/485
5,043,904 A * 8/1991 Sikes et al. ..... 101/248
5,058,500 A * 10/1991 Mizuno ..... 101/DIG. 46
5,117,365 A * 5/1992 Jeschke et al. ..... 101/248
5,181,257 A * 1/1993 Steiner et al. ..... 101/248
5,365,847 A * 11/1994 Pers ..... 101/248
5,379,211 A * 1/1995 McVenes ..... 101/248
5,500,801 A * 3/1996 Löffler ..... 101/486
5,649,484 A * 7/1997 Broghammer et al. ..... 101/248
6,167,806 B1 1/2001 Chretinat et al. ..... 101/220

* cited by examiner

*Primary Examiner*—Eugene H. Eickholt
(74) *Attorney, Agent, or Firm*—Davidson, Davidson & Kappel, LLC

(57) ABSTRACT

A method for controlling a printing press having a first image cylinder for providing at least a first cylinder first image and a first cylinder second image to a printed material and a second image cylinder for providing at least a second cylinder first image and a second cylinder second image to the printed material. The method includes printing a book having individual pages with the first cylinder first image, first cylinder second image, second cylinder first image and the second cylinder second image and providing a first operational mode to an operator of the printing press. The first operational mode permits the operator to review the pages with the first cylinder first image and the first cylinder second image of the book at the same time and to alter the registration of the first image cylinder providing the first cylinder first image and first cylinder second image. The first operational mode also permits an operator to review the pages with the second cylinder first image and the second cylinder second image at the same time and to alter the registration of the second image cylinder providing the second cylinder first image and second cylinder second image. A different second operational mode is provided to the operator for altering characteristics of the individual pages of the book, such as ink zone control.

13 Claims, 5 Drawing Sheets

DEVICE AND METHOD FOR CONTROLLING REGISTRATION IN A PRINTING PRESS

BACKGROUND INFORMATION

The present invention relates to a device and method for controlling registration in a printing press.

U.S. Pat. No. 6,167,806, hereby incorporated by reference herein, describes a control device for controlling the printing of a web of material in a rotary printing press from a control panel. As described in the patent, an operator receives a printed product from the printing press and lays the product on an analysis table. The operator flips through the product to check various attributes, for example, proper color, ink key application, and proper registration.

For example, a newspaper printing press 100, schematically shown in FIG. 2 as a two-tower press each with two-wide plate cylinders, may print a four-color newspaper 10 in an eight page format, with pages A1, A8, and A2, A7 being printed on one web 103 and pages A3, A6 and A4, A5 on another web 102. The webs are combined in a folder 110, which folds and cuts the webs 102, 103 so that newspapers 10 result. Thus a two-image-wide plate cylinder 120 may print the cyan image for A1, A8, as shown in FIG. 3 for example. Plate cylinder 122 may print the cyan image for A2, A7, while plate cylinder 124 prints the cyan image for A3, A4 and plate cylinder 126 the cyan image for A4, A5. Magenta, yellow and black can, for example, be printed by the other print couples.

To check the attributes of the newspaper, an operator would take one of the newspapers 10, and lay it on an analysis table. In a page mode, the operator would typically start with A1, check its attributes and make any changes to the ink keys or registration, then flip to pages A2:A3 and check both of the these pages, then check pages A4:A5, and then the pages A6:A7 and finally the rear page A8.

If the operator in the page mode, for example, alters the lateral register of the plate cylinder 120, the register of both pages A1 and A8 is affected. Thus an operator flipping through newspaper 10 in page mode might correct the lateral register for the cyan for page A1, which alters the lateral register for both page A1 and page A8, as they are printed by the same plate cylinder. When the operator flips to page A8 and notices that the register is improper, the operator may make the mistake of again correcting the register for page A8, even though this has already been corrected. Both image A1 and A8 thus may end up out of register, as shown schematically in FIG. 3, which shows multi-plate plate cylinder 120 moving laterally with both images A1 and A8.

While a two-tower printing press is described above, the same problem results in a four-image-wide printing press where some of the images are registered together, i.e. where each image on a plate cylinder is not independently registerable.

BRIEF SUMMARY OF THE INVENTION

An object of the present invention is to permit an operator to accurately adjust the register in a multi-plate printing press where at least two images arc registered together.

Another alternate or additional object of the present invention is to reduce mistaken duplication of registration commands during a page mode.

The present invention provides a method for controlling a printing press having a first image cylinder for providing at least a first cylinder first image and a first cylinder second image to a printed material and a second image cylinder for providing at least a second cylinder first image and a second cylinder second image to the printed material, the method comprising the steps of:

printing a book having individual pages with the first cylinder first image, first cylinder second image, second cylinder first image and the second cylinder second image, providing a first operational mode to an operator of the printing press, the first operational mode permitting the operator to review the pages with the first cylinder first image and the first cylinder second image of the book at the same time and to alter the registration of the first image cylinder providing the first cylinder first image and first cylinder second image, the first operational mode also permitting an operator to review the pages with the second cylinder first image and the second cylinder second image at the same time and to alter the registration of the second image cylinder providing the second cylinder first image and second cylinder second image; and providing a different second operational mode to the operator for altering characteristics of the individual pages of the book.

By providing a first operation mode, referred to herein as the book mode, the user can flip through folios of a section to set the register for the folio. For example, with the eight-page book of FIG. 1, the user can place the folio with A1:A8 on the analysis table, alter the registration for the cylinder 120 printing A1:A8, then move the folio with A1:A8 to the side and place the folio with A3:A6 on the analysis table and alter the registration of cylinder 124. The operator then can flip the A3:A6 folio to alter the registration for A4:A5 via cylinder 126 and then retrieve the A1:A8 folio and flip to review A2:A7 for proper registration of cylinder 128. Alternately, the operator could have flipped the A1:A8 folio and checked A2:A7 and then discarded the folio before proceeding to the A3:A6 folio. The operator can retrieve further check copies from the printing press to ensure proper registration.

Once registration in the book mode is proper, the operator can move to the second operation mode, referred to herein as page mode, and use another check copy of the book to flip through the pages A1 to A8 in normal fashion to adjust ink zones and fountains, dampening zones and any other features to correct the page image.

The present invention advantageously permits the operator to correct registration of multi-plate plate cylinders by viewing the actually images at one time printed by the plate cylinder, and thus can reduce confusion caused by having the operator register the pages in a page mode.

The book mode preferably occurs before the page mode.

Preferably, the folio placed on the analysis table during book mode is automatically identified and correlated to a specific image cylinder.

Preferably, the printing press has additional multi-image image cylinders, the book mode permitting registration correction for folios printed by the additional image cylinders, and the page mode permitting individual page correction.

The present invention also provides a printing press comprising a first image cylinder for providing at least a first cylinder first image and a first cylinder second image to a printed material and a second image cylinder for providing at least a second cylinder first image and a second cylinder second image to the printed material, and a control unit for controlling the printing press. The control unit includes a first operational mode, the first operational mode permitting review of pages with the first cylinder first image and the first cylinder second image of the book at the same time. The control unit can control a registration unit for altering the registration of the first image cylinder having the first cylinder first image and first cylinder second image, as a function of an operator input while in the first operational mode. The first operational mode also permits an operator to review the pages with the second cylinder first image and the second cylinder second image at the same time and to alter the registration of the second image cylinder having the second cylinder first image and second cylinder second image. The control unit also provides a different second operational mode to the operator for altering characteristics of the individual pages of the book.

Preferably, the control unit includes an analysis table for receiving pages of a printed book, and a scanning unit for scanning pages of the book. In book mode, the control unit can identify the scanned pages and correlate them with one of the image cylinders. For example, the control unit can store the images on each of the image cylinders, and compare the scanned images from the analysis table during book mode to the stored images. The control unit can then identify the proper registration unit to send registration commands to.

The control unit can receive inputs from a user interface displaying the current operational mode, the user interface permitting the operator to select the book or page operational mode.

The printing press may include a lateral registration device for each image cylinder, the lateral registration device registering at least two images together. Preferably, the images on the multi-image image cylinder are not individually registerable.

Preferably, the printing press is an offset lithographic web printing press and the image cylinders are plate cylinders.

Image cylinder as defined herein includes any type of cylinder for providing an image, such as a plate cylinder.

BRIEF DESCRIPTION OF THE DRAWINGS

The prior art is described with respect to the following three figures described above in which.

Figure 1:
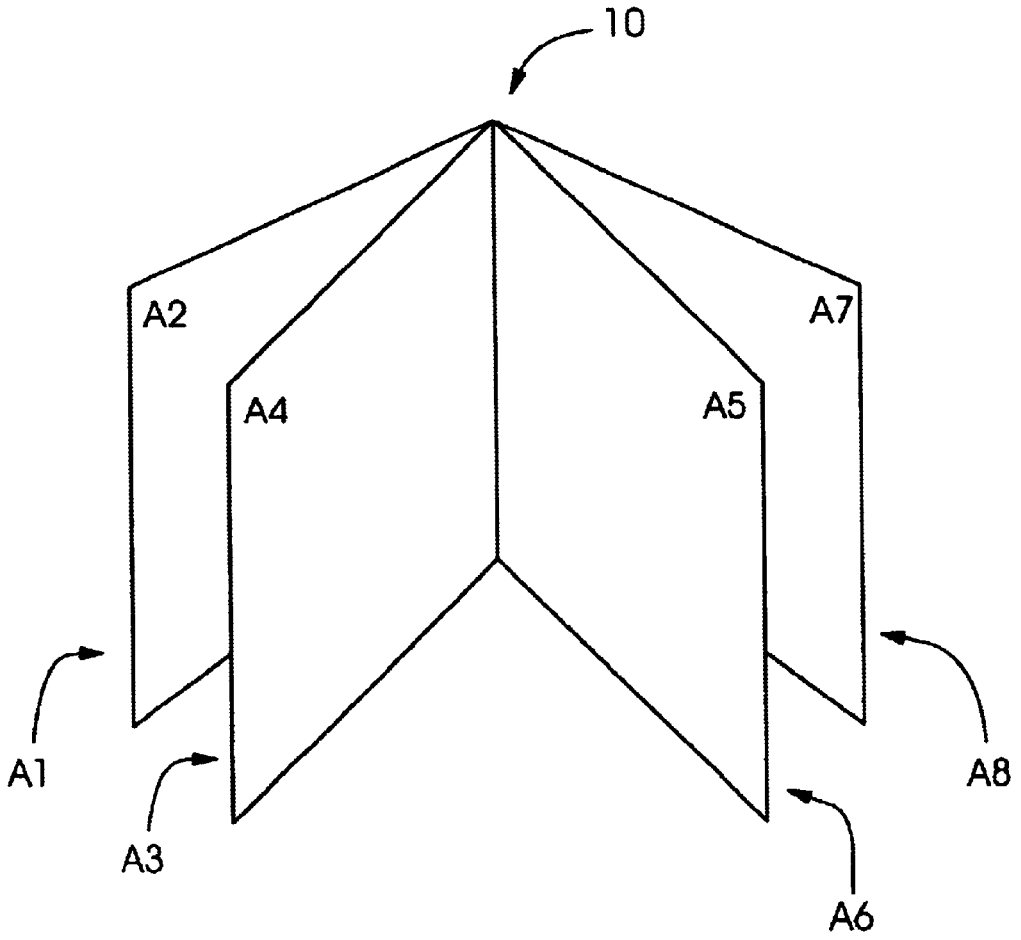
Fig.1 ( PRIOR ART)
FIG. 1 shows an eight page book.
Figure 2:
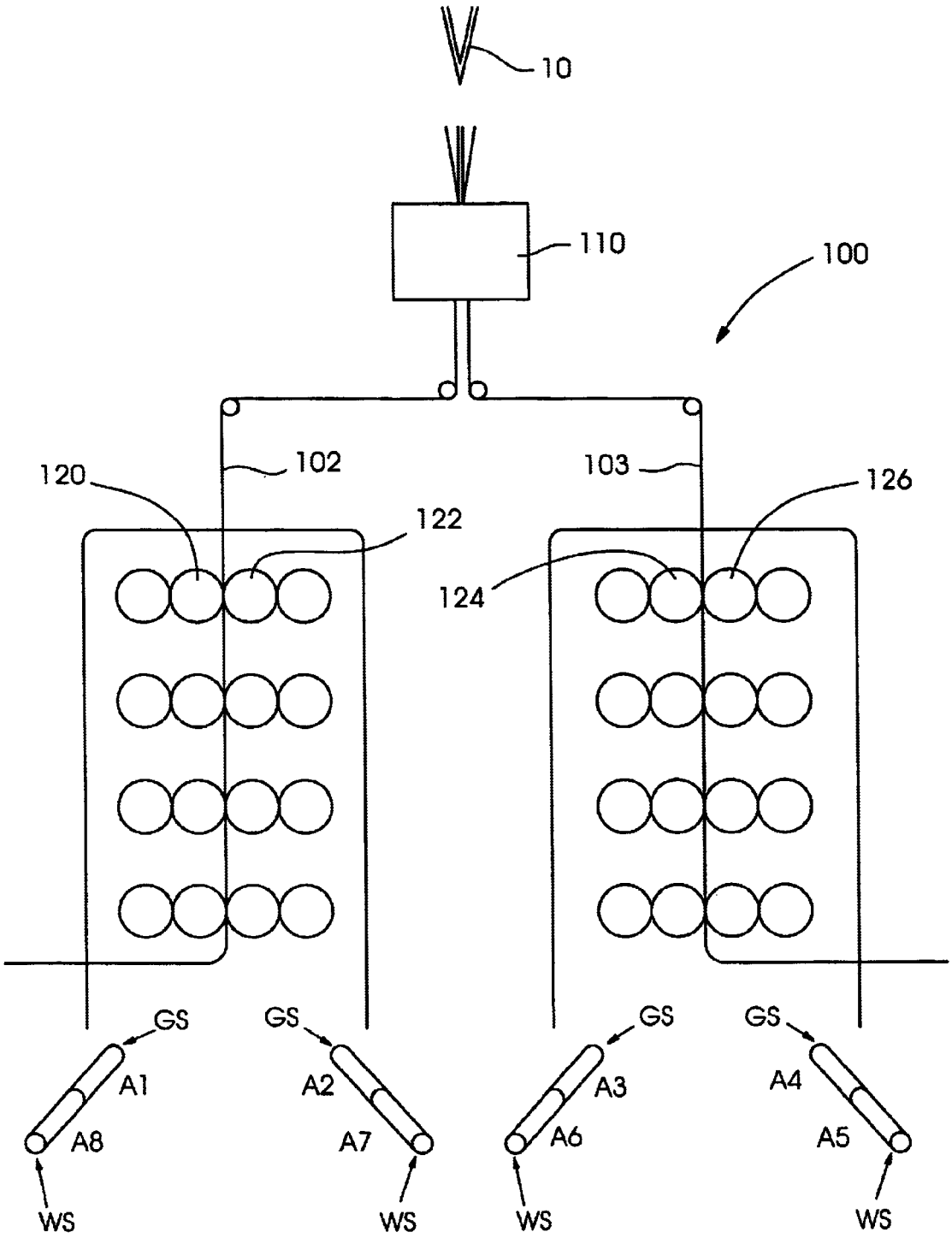
Fig.2 (PRIOR ART)
FIG. 2 shows schematically a prior art two-tower offset web printing press with multi-plate plate cylinders for printing the eight page book.
Figure 3:
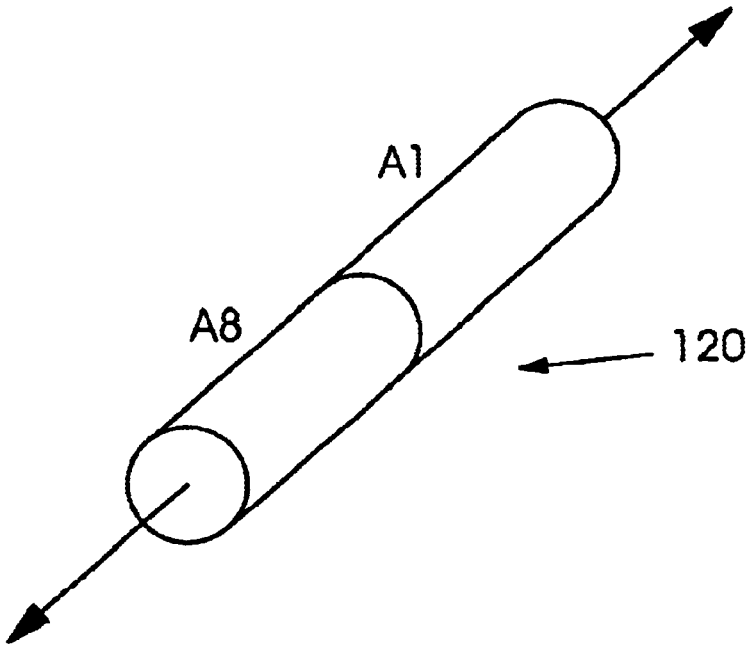
Fig.3 (PRIOR ART)
FIG. 3 shows schematically one of the multi-plate plate cylinders being axially, i.e. laterally, registered.
Figure 4:
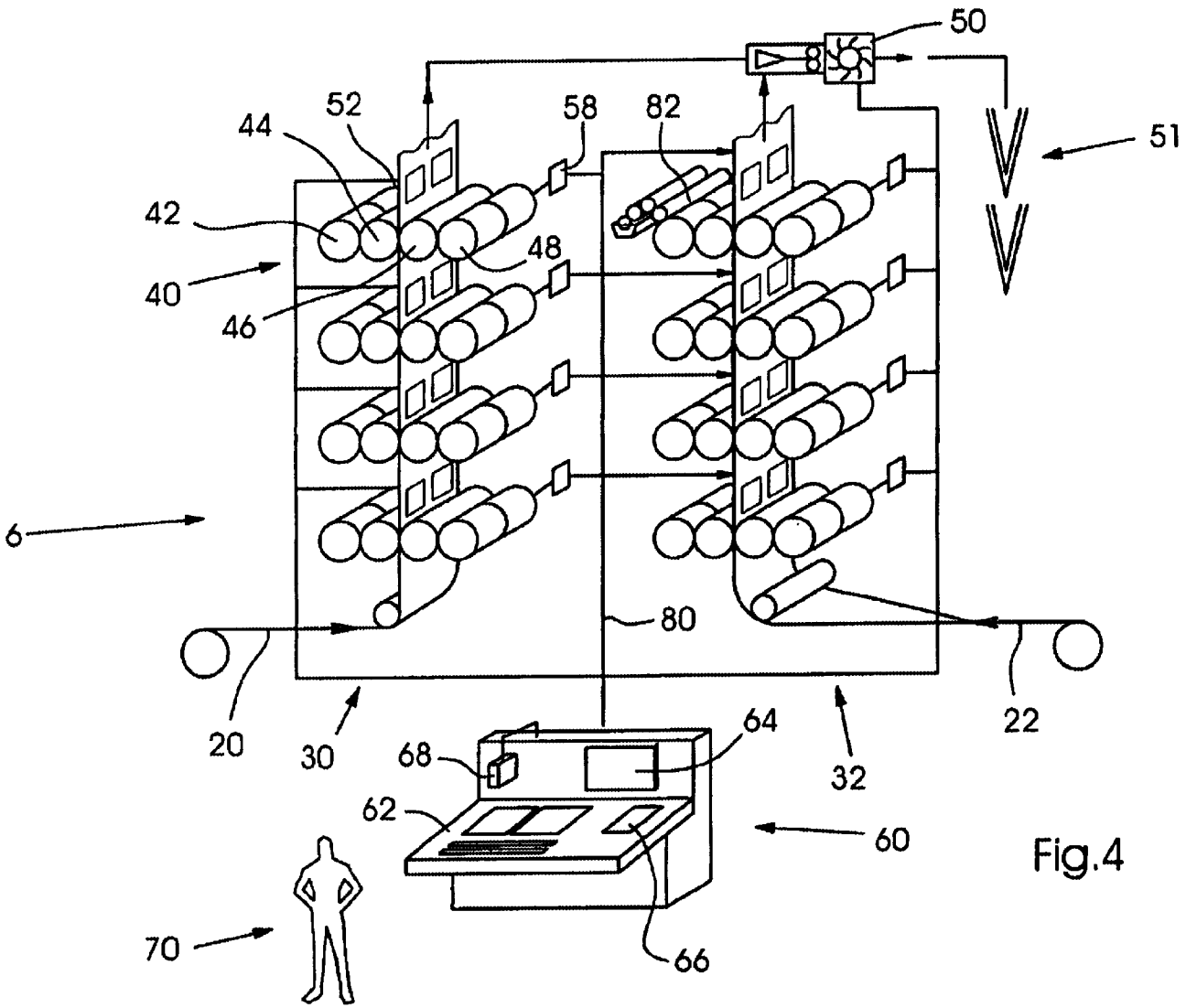
Figure 5:
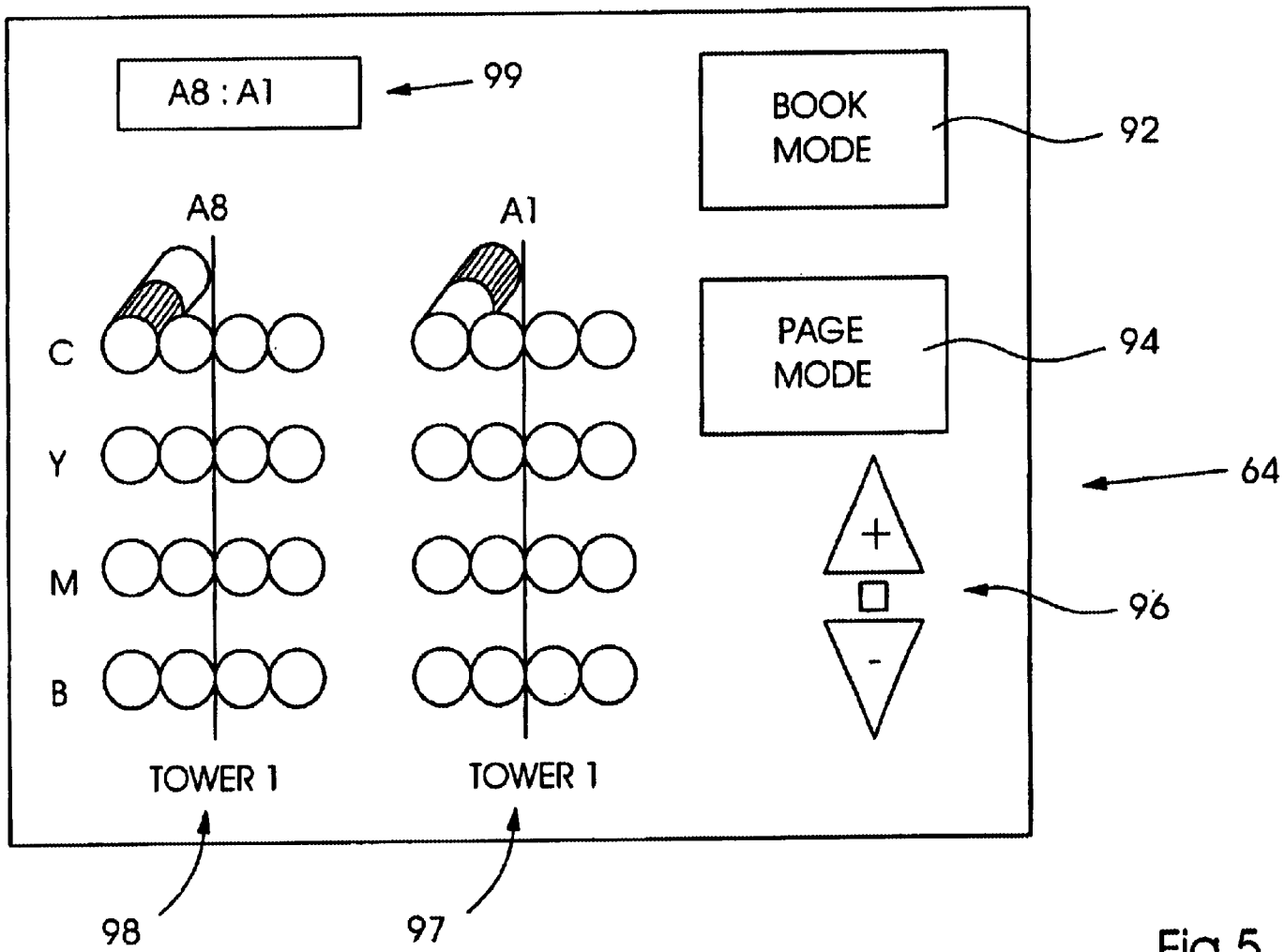

The present invention will be described in more detail with reference to a preferred offset lithographic web printing press with a control unit according to the present invention, in which:

FIG. 4 shows a schematic view of an offset lithographic printing press with the control unit according to the present invention; and FIG. 5 shows a schematic view of a graphical user interface of the control unit.

DETAILED DESCRIPTION OF A PREFERRED EMBODIMENT

FIG. 4 describes a preferred offset lithographic printing press 6 with a first tower 30 for printing a web 20 and a second tower 32 for printing a web 22. Each tower 30, 32 may have four pairs of print couples for printing magenta, cyan, yellow and black, for example. While two towers 30, 32 are described for clarity in describing the registration, a single four-wide printing press with two of the images being registered together and having a slitter in the folder could also be used to produce similar printed products.

A pair 40 of print couples has for example a first two-wide plate cylinder 42, a first blanket cylinder 44, a second blanket cylinder 46 and a second two-wide plate cylinder 48. Each of the plate cylinders 42, 48 is registerable in the circumferential and axial directions by registration devices 52, 58, respectively. The two images on the plates are not individually registrable, as the registration device moves the entire plate cylinder.

An inking unit 82 is provided for each plate cylinder, as is a dampening unit.

The printed webs 30, 32 pass to a folder 50, which combines the webs, and cuts and folds them into books 51, for example eight page broadsheet books.

Folder 50 however can provide other book configurations, and more webs from other print units can be provided to folder 50 and slitting of the various webs may occur.

An operator 70 can receive the printed books 51, and take a check copy of the book 51 to an analysis table 62 of a control unit 60. Operator 70 can choose a book mode of the control unit 60, for example using a user interface pad 66 or a touch screen or graphical user interface 64. As shown in FIG. 5, a display 92 for book mode is then highlighted, for example by underlining, to alert the operator that book mode has been selected.

Once book mode is selected, the control unit 60, which knows which imposition format, for example eight page broadsheet, is being printed, can inform the operator which page pair, A1:A8, A3:A6, A2:A7 or A4:A5, to lay on the analysis table 62 in a block 99, as shown in FIG. 5. A scanner 68 can confirm the proper pair has been selected and can display graphically the location of the plates associated with each color for each page, for example the cyan plate for page A8 at the front (workside) of cylinder 42 as per location 98 and for page A1 at the rear (gearside) of cylinder 42 in tower 30 as per location 97 of the graphical user interface 64.

The operator can then alter for example the circumferential registration of cylinder 42 via a touch screen registration control 96. This can occur for each color couple of the press via network 80, for example an Ethernet based network, and registration units 52, 58, which are provided for each print couple pair.

Once all of the page pairs A1:A8, A2:A7, A3:A6 and A4:A5 for each color in the book mode have been properly registered, both axially and circumferentially if required, the operator can switch to page mode 94. In this mode, further corrections can be made, as discussed in commonly-assigned U.S. Pat. No. 6,167,806, hereby incorporated by reference herein.

While the present invention has been described for simplicity with two print towers, it should realized that a single print tower with four-wide plate cylinders, each with two pairs of side-by-side images registered together, the web then being slit, would function similarly to the two tower construction. In addition, other configurations are possible, the invention being equally applicable to other printing presses in which two side-by-side images on an image cylinder are not individually registerable. The pages of the book from these side by side images may be separate or connected.

It also should be noted that if operator 70 knows which plate cylinder corresponds to which pages, operator 70 can merely flip through the page pairs without the control unit 60 telling the operator which pair to place on the table, and the scanner 68 can identify the proper page pair to display in block 99. However, with more than two webs and three or more wide plate cylinders, all of which fall within the scope of the present invention, this becomes difficult, and it is preferable if the control unit 60 displays the desired pages to be placed on the table 62.

Control unit 60 includes processor, for example one available commercially from the Intel Corporation, and data storage unit.

What is claimed is:

1. A method for controlling a printing press having a first image cylinder for providing at least a first cylinder first image and a first cylinder second image to a printed material and a second image cylinder for providing at least a second cylinder first image and a second cylinder second image to the printed material, the method comprising the steps of:

printing a book having individual pages with the first cylinder first image, first cylinder second image, second cylinder first image and the second cylinder second image, providing a first operational mode to an operator of the printing press, the first operational mode permitting the operator to review the pages with the first cylinder first image and the first cylinder second image of the book at the same time and to alter the registration of the first image cylinder providing the first cylinder first image and first cylinder second image, the first operational mode also permitting an operator to review the pages with the second cylinder first image and the second cylinder second image at the same time and to alter the registration of the second image cylinder providing the second cylinder first image and second cylinder second image; and providing a different second operational mode to the operator for altering characteristics of the individual pages of the book.

2. The method as recited in claim 1 further comprising adjusting ink zones and fountains in the second operational mode.

3. The method as recited in claim 1 wherein during the characteristics of the second operational mode the first cylinder second image and second cylinder first image can both be altered.

4. The method as recited in claim 1 wherein the first operational mode occurs before the second operational mode.

5. The method as recited in claim 1 wherein the pages with the first cylinder first image and first cylinder second image are scanned during the first operational mode and correlated to the first image cylinder.

6. The method as recited in claim 1 wherein the printing press has additional multi-image image cylinders, the first operational mode permitting registration correction for additional pages printed by the additional image cylinders, and the second operational mode permitting individual page correction.

7. A printing press comprising:

a first image cylinder for providing at least a first cylinder first image and a first cylinder second image to a printed material;

a second image cylinder for providing at least a second cylinder first image and a second cylinder second image to the printed material;

a control unit having a first operational mode, the first operational mode permitting review of pages with the first cylinder first image and the first cylinder second image of the book at the same time;

a first registration unit controlled by the control unit, the control unit controlling the registration of the first image cylinder as a function of an operator input while in the first operational mode;

a second registration unit controlled by the control unit, the control unit controlling registration of the second image cylinder as a function of another operator input while in the first operational mode;

the control unit also providing a different second operational mode to the operator for altering characteristics of the individual pages of the book.

8. The printing press as recited in claim 7 further comprising a first inker for the first image cylinder and a second inker for the second cylinder, the first inker having a first ink delivery for the first cylinder first image and the second inker having a second ink delivery for the second cylinder first image, the control unit in the second operational mode permitting control of the first and second ink delivery.

9. The printing press as recited in claim 7 wherein the control unit includes an analysis table for receiving pages of a printed book, and a scanning unit for scanning pages of the book.

10. The printing press as recited in claim 7 wherein the control unit stores data regarding the first image cylinder and second image cylinder for comparison to scanned images.

11. The printing press as recited in claim 7 wherein a graphical user interface displays one of the first operational mode and the second operational mode.

12. The printing press as recited in claim 7 further comprising a folder, the folder being controlled by the control unit.

13. The printing press as recited in claim 7 wherein the printing press is an offset lithographic web printing press.

* * * * *